US008070548B2

(12) United States Patent
Xiao et al.

(10) Patent No.: US 8,070,548 B2
(45) Date of Patent: Dec. 6, 2011

(54) METHOD FOR MAKING THERMAL ELECTRON EMITTER

(75) Inventors: Lin Xiao, Beijing (CN); Liang Liu, Beijing (CN); Chang-Hong Liu, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 289 days.

(21) Appl. No.: 12/381,576

(22) Filed: Mar. 12, 2009

(65) Prior Publication Data

US 2009/0258448 A1 Oct. 15, 2009

(51) Int. Cl.
*H01J 9/12* (2006.01)

(52) U.S. Cl. ..... 445/49; 445/50; 445/51; 313/310

(58) Field of Classification Search ..... 313/309–311, 313/495–497; 445/49–51
See application file for complete search history.

(56) References Cited

U.S. PATENT DOCUMENTS 5,967,873 A 10/1999 Rabinowitz
7,828,619 B1 * 11/2010 Yeh ..... 445/49
2003/0036332 A1 2/2003 Talin et al.
2003/0090190 A1 5/2003 Takai et al.
2004/0102044 A1 5/2004 Mao et al.
2005/0127814 A1 6/2005 Deguchi et al.
2005/0200261 A1 * 9/2005 Mao et al. ..... 313/311
2006/0090996 A1 * 5/2006 Yaniv et al. ..... 204/157.15
2007/0111628 A1 * 5/2007 Yagi et al. ..... 445/24
2008/0105544 A1 * 5/2008 Shigematsu et al. ..... 204/400
2008/0164801 A1 * 7/2008 Min et al. ..... 313/309
2008/0170982 A1 * 7/2008 Zhang et al. ..... 423/447.3
2009/0160306 A1 6/2009 Xiao et al.

FOREIGN PATENT DOCUMENTS

CN 101465254 6/2009
CN 101465254 A 6/2009

* cited by examiner

*Primary Examiner* — Bumsuk Won
(74) *Attorney, Agent, or Firm* — Altis Law Group, Inc.

(57) ABSTRACT

A method for making the thermal electron emitter includes following steps. Providing a carbon nanotube film including a plurality of carbon nanotubes. Treating the carbon nanotube film with a solution comprising of a solvent and compound or a precursor of a compound, wherein the compound and the compound that is the basis of the precursor of a compound has a work function that is lower than the carbon nanotubes. Twisting the treated carbon nanotube film to form a carbon nanotube twisted wire. Drying the carbon nanotube twisted wire. Activating the carbon nanotube twisted wire.

20 Claims, 3 Drawing Sheets

METHOD FOR MAKING THERMAL ELECTRON EMITTER

RELATED APPLICATIONS

This application is related to commonly-assigned, co-pending applications: U.S. patent application Ser. No. 12/006,305, entitled "METHOD FOR MANUFACTURING FIELD EMISSION ELECTRON SOURCE HAVING CARBON NANOTUBES", filed on Dec. 29, 2007; U.S. patent application Ser. No. 12/080,604, entitled "THERMAL ELECTRON EMISSION SOURCE HAVING CARBON NANOTUBES AND METHOD FOR MAKING THE SAME", filed on Apr. 4, 2008; and U.S. patent application Ser. No. 12/381,620, entitled "THERMAL ELECTRON THERMAL ELECTRON EMITTER AND THERMAL ELECTRON EMISSION DEVICE USING THE SAME", filed on Mar. 12, 2009. The disclosure of the above-identified applications are incorporated herein by reference.

BACKGROUND

1. Field of the Invention

The present invention relates to a method for making a thermal electron emitter based on carbon nanotubes.

2. Discussion of Related Art

Thermal electron emission devices are widely applied in gas lasers, arc-welders, plasma-cutters, electron microscopes, x-ray generators, and the like. Conventional thermal electron emission devices are constructed by forming an electron emissive layer made of alkaline earth metal oxide on a base. The alkaline earth metal oxide includes BaO, SrO, CaO, or a mixture thereof. The base is made of an alloy including at least one of Ni, Mg, W, Al and the like. When thermal electron emission devices are heated to a temperature of about 800° C., electrons are emitted from the thermal electron emission source. Since the electron emissive layer is formed on the surface of the base, an interface layer is formed between the base and the electron emissive layer. Therefore, the electron emissive alkaline earth metal oxide is easy to split off from the base. Further, thermal electron emission devices are less stable because alkaline earth metal oxide is easy to vaporize at high temperatures. Consequently, the lifespan of the electron emission device tends to be low.

What is needed, therefore, is a method for making a thermal electron emitter, which has high stable electron emission, as well as great mechanical durability.

BRIEF DESCRIPTION OF THE DRAWINGS

Many aspects of the present method for making the thermal electron emitter can be better understood with references to the following drawings. The components in the drawings are not necessarily drawn to scale, the emphasis instead being placed upon clearly illustrating the principles of the present method for making the thermal electron emitter.

Figure 1:
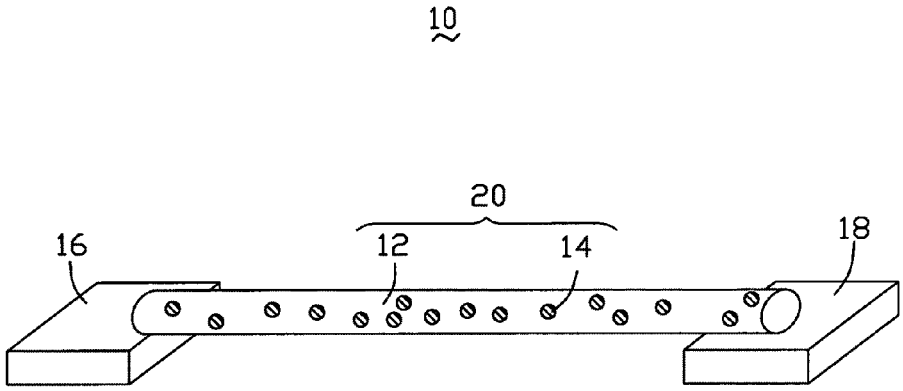
FIG. 1 is a schematic view of a thermal electron emission device, in accordance with a present embodiment.

Corresponding reference characters indicate corresponding parts throughout the several views. The exemplifications set out herein illustrate at least one embodiment of the present method for making the thermal electron emitter, in at least one form, and such exemplifications are not to be construed as limiting the scope of the invention in any manner.

DETAILED DESCRIPTION

References will now be made to the drawings to describe, in detail, various embodiments of the present method for making the thermal electron emitter.

Referring to FIG. 1, a thermal electron emission device 10 includes a thermal electron emitter 20, a first electrode 16, and a second electrode 18. The thermal electron emitter 20 includes a carbon nanotube twisted wire 12 and a number of electron emission particles 14. The twisted wire 12 is configured to serve as a matrix. The electron emission particles 14 are uniformly dispersed either inside or on surface of the twisted wire 12. Two opposite ends of the twisted wire 12 are electrically connected to the first electrode 16 and the second electrode 18, respectively. In the present embodiment, the twisted wire 12 is contacted to the first electrode 16 and the second electrode 18 with a conductive paste/adhesive, such as a silver paste.

Figure 2:
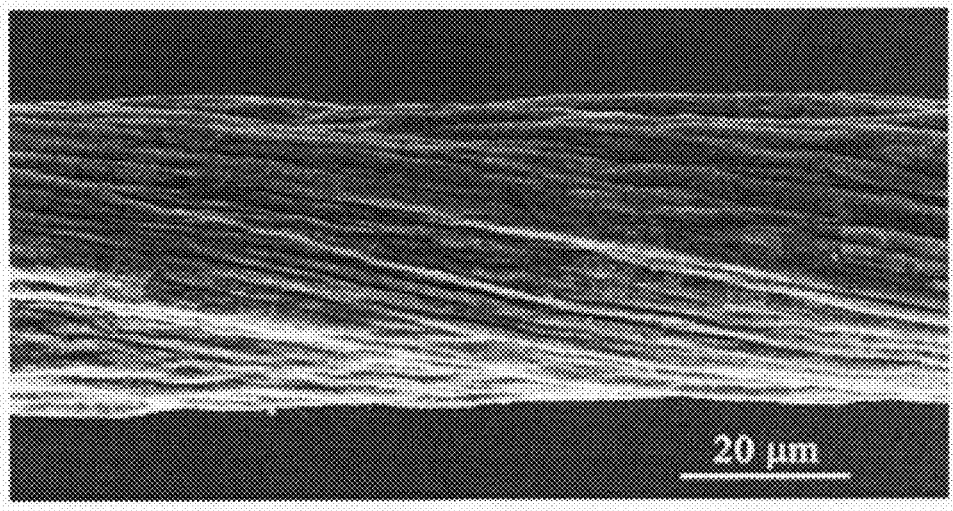
FIG. 2 is a Scanning Electron Microscope (SEM) image of a carbon nanotube twisted wire of the thermal electron emitter, in accordance with a present embodiment.

Referring to FIG. 2, the twisted wire 12 includes a plurality of successively oriented carbon nanotubes. The adjacent carbon nanotubes are entangled with each other. The adjacent carbon nanotubes are joined by van der Waals attractive force. The carbon nanotubes of the twisted wire 12 can be selected from the group consisting of single-walled carbon nanotubes, double-walled carbon nanotubes, multi-walled carbon nanotubes, and combinations thereof. Diameters of the single-walled carbon nanotubes range from about 0.5 to about 50 nanometers (nm). Diameters of the double-walled carbon nanotubes range from about 1 to about 50 nm. Diameters of the multi-walled carbon nanotubes range from about 1.5 to about 50 nm. A length of the carbon nanotubes is more than about 50 micrometers (μm). In the present embodiment, lengths of the carbon nanotubes range from about 200 μm to about 900 μm. The electron emission particles 14 are attached to the surfaces of the carbon nanotubes of the twisted wire 12. The twisted wire 12 has a stranded structure, with the carbon nanotubes being twisted by a spinning process. Diameter of the twisted wire 12 is in an approximate range of 20 μm to 1 millimeter (mm). However, length of the twisted wire 12 is arbitrary. In the present embodiment, the length of the twisted wire 12 is in an approximate range from 0.1 to 10 centimeters (cm).

The electron emission particles 14 are made of at least one low work function material selected from the group consisting of alkaline earth metal oxides, alkaline earth metal borides, and mixtures thereof. The alkaline earth metal oxides are selected from the group consisting of barium oxide (BaO), calcium oxide (CaO), strontium oxide (SrO), and mixtures thereof. The alkaline earth metal borides are selected from the group consisting of thorium boride (ThB), yttrium boride (YB), and mixtures thereof. Diameters of the electron emission particles 14 are in a range of 10 nanometers (nm) to 100 μm.

Mass ratio of the electron emission particles 14 to the twisted wire 12 ranges from 50% to 90%. In the present embodiment, at least part of the electron emission particles 14 are dispersed in the twisted wire 12 and on the surface of the carbon nanotubes.

The temperature at which the thermal electron emitter 20 emits electrons depend on the number of the electron emission particles 14 included in the twisted wire 12. The more electron emission particles 14 included in the twisted wire 12, the lower the temperature at which the thermal electron emitter 20 will emit electrons. In the present embodiment, electrons are emitted from the thermal electron emitter 20 at around 800° C.

In some embodiments, the thermal electron emitter 20 may include two or more twisted wires 12, which are then twisted together. Thus, the thermal electron emitter 20 has a larger diameter and high mechanical durability, and can be used in macro-scale electron emission devices.

In other embodiments, the thermal electron emitter 20 may include at least one twisted wire 12 and at least one conductive wire (not shown). The at least one twisted wire 12 and at least one conductive wire are twisted together. Thus, the thermal electron emitter 20 has high mechanical durability and flexility. The conductive wire can be made of metal or graphite.

The first and second electrodes 16 and 18 are separated and insulated from each other. The first and second electrodes 16 and 18 are made of a conductive material, such as metal, alloy, carbon nanotube or graphite. In the present embodiment, the first and second electrodes 16, 18 are copper sheets electrically connected to an external electrical circuit (not shown).

Compared with conventional thermal electron emission devices, the present thermal electron emission device has the following advantages. Firstly, the included carbon nanotubes are stable at high temperatures in vacuum, thus the thermal electron emission device has stable electron emission characteristics. Secondly, the electron emission particles are uniformly dispersed in the carbon nanotube wire, providing more electron emission particles to emit more thermal electrons. Accordingly, the electron-emission efficiency thereof is improved. Thirdly, the carbon nanotube matrix of the present thermal emission device is mechanically durable, even at relatively high temperatures. Thus, the present thermal emission source can be expected to have a longer lifespan and better mechanical behavior when in use, than previously available thermal emission devices. Fourthly, the carbon nanotubes have large specific surface areas and can adsorb more electron emission particles, thus enabling the thermal electron emission device to emit electrons at lower temperatures.

In operation, a voltage is applied to the first electrode 16 and the second electrode 18, thus current flows through the twisted wire 12. The twisted wire 12 then heats up efficiently according to Joule/resistance heating. The temperature of the electron emission particles 14 rises quickly. When the temperature is about 800° C. or more, electrons are emitted from the electron emission particles 14.

Figure 3:
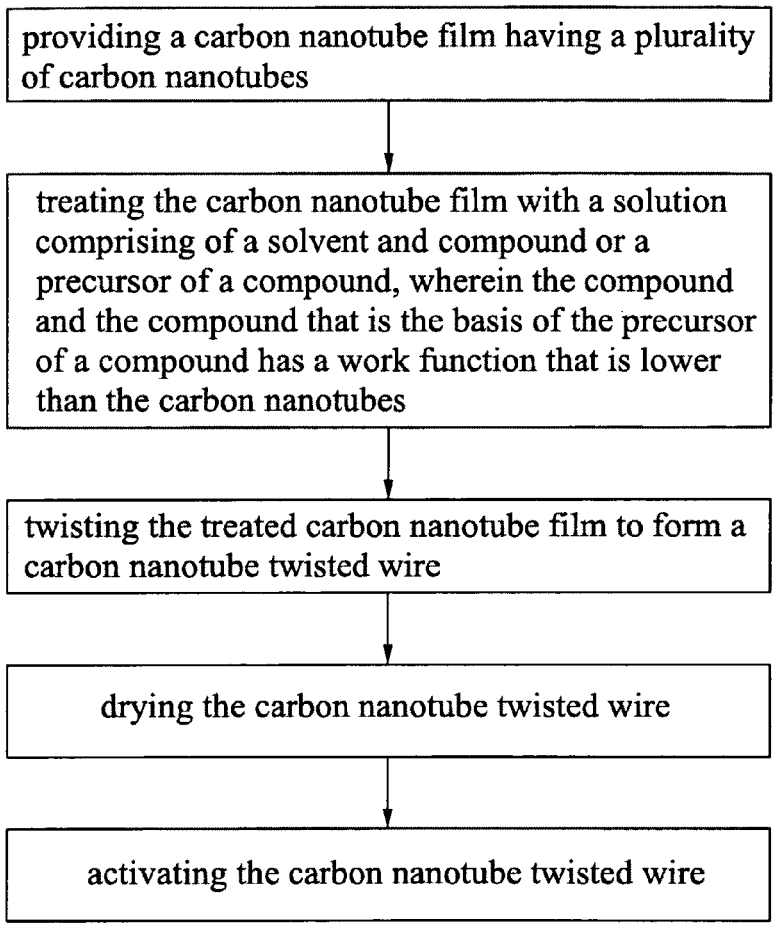
FIG. 3 is a flow chart of a method for making a thermal electron emitter, in accordance with a present embodiment.

Referring to FIG. 3, a method for making the thermal electron emitter 20 includes the following steps of: (a) providing a carbon nanotube film having a plurality of carbon nanotubes; (b) treating the carbon nanotube film with a solution comprising of a solvent and compound or a precursor of a compound, wherein the compound and the compound that is the basis of the precursor of a compound has a work function that is lower than the carbon nanotubes; (c) twisting the treated carbon nanotube film to form a carbon nanotube twisted wire; (d) drying the carbon nanotube twisted wire; and (e) activating the carbon nanotube twisted wire.

In step (a), at least one carbon nanotube film having a plurality of carbon nanotubes is provided. In particular, the step (a) can include the steps of: (a1) providing an array of carbon nanotubes; and (a2) providing a pressing device to press the array of carbon nanotubes, thereby forming a carbon nanotube film.

In step (a1), an array of carbon nanotubes can be formed by the steps of: (a11) providing a substantially flat and smooth substrate; (a12) forming a catalyst layer on the substrate; (a13) annealing the substrate with the catalyst layer in air at a temperature ranging from 700° C. to 900° C. for about 30 to 90 minutes; (a14) heating the substrate with the catalyst layer to a temperature ranging from 500° C. to 740° C. in a furnace with a protective gas therein; and (a15) supplying a carbon source gas to the furnace for about 5 to 30 minutes and growing the array of carbon nanotubes on the substrate.

In step (a11), the substrate can be a P-type silicon wafer, an N-type silicon wafer, or a silicon wafer with a film of silicon dioxide thereon.

In step (a12), the catalyst layer can be made of iron (Fe), cobalt (Co), nickel (Ni), or any alloy thereof.

In step (a14), the protective gas can be made up of at least one of nitrogen ($N_2$), ammonia ($NH_3$), and a noble gas. In step (a15), the carbon source gas can be a hydrocarbon gas, such as ethylene ($C_2H_4$), methane ($CH_4$), acetylene ($C_2H_2$), ethane ($C_2H_6$), or any combination thereof.

The array of carbon nanotubes has a height of about 200 to about 900 μm. The carbon nanotubes in the array are parallel to each other and approximately perpendicular to the substrate. The carbon nanotubes can be selected from the group consisting of single-walled carbon nanotubes, double-walled carbon nanotubes, and multi-walled carbon nanotubes. A diameter of each single-walled carbon nanotube ranges from about 0.5 to about 50 nanometers (nm). A diameter of each double-walled carbon nanotube ranges from about 1 to about 50 nm. A diameter of each multi-walled carbon nanotube ranges from about 1.5 to about 50 nm.

The array of carbon nanotubes formed under the above conditions is essentially free of impurities, such as carbonaceous or residual catalyst particles. The carbon nanotubes in the array are closely packed together by van der Waals attractive force.

In step (a2), a certain pressure can be applied to the array of carbon nanotubes by the pressing device. In the process of pressing, the carbon nanotubes form the carbon nanotube film under pressure. The carbon nanotubes are nearly all parallel to a surface of the carbon nanotube film. In one embodiment, the carbon nanotube film is formed in a circular shape with a diameter of about 10 centimeters.

In one embodiment, the pressing device includes a pressure head. The pressure head has a glossy surface. It is to be understood that, the shape of the pressure head and the pressing direction can, opportunely, determine the arranged direction of the carbon nanotubes in the carbon nanotube film. Specifically, when a planar pressure head is used to press the array of carbon nanotubes along the direction perpendicular to the substrate, and carbon nanotubes of the carbon nanotube film are isotropically arranged. When a roller-shaped pressure head is used to press the array of carbon nanotubes along a fixed direction, the carbon nanotubes of the carbon nanotube film will align along the fixed direction. When a roller-shaped pressure head is used to press the array of carbon nanotubes along different directions, the carbon nanotubes of the carbon nanotube film will align along different directions.

In the process of pressing, the carbon nanotubes will be slanted, thereby forming the carbon nanotube film. The carbon nanotubes in the film are connected to each other by Waals attractive force therebetween and form a free-standing structure. The free-standing structure allows the film to maintain a certain shape without any support. The carbon nanotubes in the free-standing structure are nearly all parallel to a surface of the carbon nanotube film, and can be isotropically arranged, arranged along a fixed direction, or arranged along different directions. The arrangement is only limited by the pressing method.

It is to be understood that, an angle of slant of the carbon nanotubes of the carbon nanotube film corresponds to the amount of pressure applied thereon. The greater the pressure applied, the larger the degree of the angle of slant is obtained. A thickness of the carbon nanotube film is opportunely determined by the height of the array of carbon nanotubes and the applied pressure. That is, the higher the array of carbon nanotubes is and the less pressure that is applied, the greater the thickness of the carbon nanotube film.

In one present embodiment, the carbon nanotube film is obtained by using a pressing device to press on the array of carbon nanotubes. Because the carbon nanotubes are uniformly dispersed in the array of carbon nanotubes, the carbon nanotube film includes a plurality of uniformly dispersed carbon nanotubes. In addition, the carbon nanotubes in the film are connected to each other by Van der Waals attractive force therebetween. Therefore, the carbon nanotube film has good mechanical and tensile strength, and is easily processed. In practical use, the carbon nanotube film can be cut into any desired shape and size.

Step (a) also can be executed by the following steps of: (a1') putting the carbon nanotubes into a solvent; (a2') causing the carbon nanotube to be clumped together into a floc structure; (a3') separating the floc structure from the solvent; and (a4') shaping the floc structure to obtain the carbon nanotube film.

In step (a1'), the carbon nanotubes can be made by the method of Chemical Vapor Deposition (CVD), Laser Ablation, or Arc-Charge. In the present embodiment, the carbon nanotubes are obtained from an array of carbon nanotubes. The array of carbon nanotubes can be formed by following the above-described step (a1). The carbon nanotubes are obtained by scraping the array of carbon nanotube from the substrate with, for example, a knife or other similar devices. Such carbon nanotubes, to a certain degree, are able to stay in a bundled state. The solvent can be water and volatile organic solvent.

In step (a2'), the carbon nanotubes can be clumped together into a floc structure by a process of flocculation. The process of flocculation is performed by ultrasonic dispersion or high-strength agitating/vibrating. In one embodiment, ultrasonic dispersion is used to flocculate the solvent containing the carbon nanotubes for about 10~30 minutes. Because the carbon nanotubes in the solvent have a large specific surface area and a large van der Waals attractive force therebetween, the carbon nanotubes are flocculated and bundled into a floc structure.

In step (a3'), the floc structure is separated from the solvent. The step (a3') includes the steps of: (a3'1) pouring the solvent containing the floc structure through a filter into a funnel; and (a3'2) drying the floc structure on the filter to obtain the separated floc structure of carbon nanotubes.

In step (a3'2), the amount of time to dry the floc structure can be selected according to practical needs. The carbon nanotubes on the filter are bundled together, so as to form an irregular floc structure.

In step (a4'), the process of shaping/molding includes the steps of: (a4'1) putting the separated floc structure into a container (not shown), and spreading the floc structure to form a predetermined structure; (a4'2) pressing the spread floc structure with a certain pressure to yield a desirable shape; and (a4'3) drying the spread floc structure to remove or volatilize the residual solvent to form a carbon nanotube film.

It is to be understood that the size of the spread floc structure may be control to achieve a desired thickness and surface density of the carbon nanotube film. As such, the larger the area over which a given the floc structure is spread, the lower the thickness and density of the carbon nanotube film.

By having the carbon nanotubes in the carbon nanotube film entangled to each other, a stronger carbon nanotube film is obtained. Therefore, the carbon nanotube film is easy to be folded and/or bent into arbitrary shapes while maintaining structural integrity. In one embodiment, the thickness of the carbon nanotube film is in the approximate range from about 1 μm to 2 mm, and the width of the carbon nanotube film is in the approximate range from 1 mm to 10 cm.

Further, the step (a3') can be accomplished by a process of pumping filtration to obtain the carbon nanotube film. The process of pumping filtration includes the steps of: (a3'3) providing a microporous membrane and an air-pumping funnel; (a3'3) filtering the solvent containing the floc structure of carbon nanotubes through the microporous membrane into the air-pumping funnel; and (a3'5) air-pumping and drying (drying can be done by the air-pumping) the floc structure of carbon nanotubes captured on the microporous membrane.

In step (a3'3), the microporous membrane has a smooth surface. And the diameters of micropores in the membrane are about 0.22 μm. The pumping filtration can exert air pressure on the floc structure, thus, forming a uniform carbon nanotube film. Moreover, due to the microporous membrane with a smooth surface, the carbon nanotube film can be easily separated from the membrane.

The carbon nanotube film produced by the second method has the following virtues. Firstly, the carbon nanotubes are bundled together by van der Walls attractive force to form a network structure/floc structure through flocculation. Thus, the carbon nanotube film is very durable. Secondly, the carbon nanotube film is easily and efficiently fabricated. In the production process of the method, the thickness and surface density of the carbon nanotube film are controllable.

The adjacent carbon nanotubes are combined and tangled by van der Waals attractive force, thereby forming a network structure/microporous structure. Thus, the carbon nanotube film has good tensile strength. In practical use, the carbon nanotube film can be cut into any desired shape and size.

In step (b), soaking the carbon nanotube film can be performed by applying the solution to the carbon nanotube film continuously or repeatedly immersing the carbon nanotube film in the solution for a period of time ranging from about 1 second to about 30 seconds. The solution infiltrates into the carbon nanotube film.

The compound, which has a work function that is lower than the carbon nanotubes, can be selected from a group consisting of alkaline earth metal oxide, alkaline earth metal boride, and mixtures thereof. The precursor of the compound is the materials which can decompose at high temperatures to form the compound which has a work function that is lower than the carbon nanotubes. The precursor of the compound is an alkaline earth metal salt. The alkaline earth metal salt can be selected from the group comprising barium nitrate, strontium nitrate, calcium nitrate and combinations thereof. The solvent is volatilizable and can be selected from the group comprising water, ethanol, methanol, acetone, dichloroethane, chloroform, and any appropriate mixture thereof.

In one embodiment, the alkaline earth metal salt is a mixture of barium nitrate, strontium nitrate, and calcium nitrate with a molar ratio of about 1:1:0.05. The solvent is a mixture of deionized water and ethanol with a volume ratio of about 1:1, and the concentration of barium ion is about 0.1-1 mol/L.

In step (c), the carbon nanotube twisted wire 12 is formed by twisting the treated carbon nanotube film with a mechanical force, and thus the mechanical properties (e.g., strength and toughness) of the carbon nanotube twisted wire 12 can be improved. The process of twisting the treated carbon nanotube film includes the following steps of: (c1) adhering a tool to at least one portion of the treated carbon nanotube film; and (c2) turning the tool at a predetermined speed to twist the treated carbon nanotube film. The tool can be turned clockwise or anti-clockwise. In one embodiment, the tool is a spinning machine. After attaching one end of the treated carbon nanotube film on to the spinning machine, turning the spinning machine at a velocity of about 200 revolutions per minute to form the carbon nanotube twisted wire 12. The alkaline earth metal salt is filled in the carbon nanotube twisted wire 12 or dispersed on the surface of the carbon nanotube twisted wire 12 after the treated carbon nanotube film is twisted with a mechanical force.

In step (d), the carbon nanotube twisted wire 12 is dried in air and at a temperature of about 100 to about 400° C. In one embodiment, the carbon nanotube twisted wire 12 is dried in air at a temperature of about 100° C. for about 10 minutes to about 2 hours. After volatilizing the solvent, the alkaline earth metal salt particles are deposited on the surface of the carbon nanotubes of the carbon nanotube twisted wire 12. In the other embodiment, the alkaline earth metal salt particles can be dispersed in the carbon nanotube twisted wire 12, dispersed on the surface of the carbon nanotube twisted wire 12 or both. In the present embodiment, the mixture of barium nitrate, strontium nitrate and calcium nitrate are dispersed in the carbon nanotube twisted wire 12 or dispersed on the surface of the carbon nanotube twisted wire 12 in the form of particles.

In step (e), the carbon nanotube twisted wire 12 can be placed into a sealed furnace having a vacuum or inert gas atmosphere therein. In one embodiment, in a vacuum of about $10^{-2}$-$10^{-6}$ Pascals (Pa), the carbon nanotube twisted wire 12 is supplied with a voltage until the temperature of the carbon nanotube twisted wire reaches about 800 to about 1400° C. Holding the temperature for about 1 to about 60 minutes, the alkaline earth metal salt is decomposed to the alkaline earth metal oxide. After being cooled to the room temperature, the thermally emissive carbon nanotube twisted wire 12 is formed, with the alkaline earth metal oxide particles uniformly dispersed on the surface of the carbon nanotubes thereof. The alkaline earth metal oxide particles thereon are the electron emission particles 14.

In others embodiments, after step (e), at least two twisted wires 12 filled with the electron emission particles 14 can be twisted together. Thus, the thermal electron emitter 20 has a larger diameter, high mechanical durability and can be used in macro electron emission devices.

Alternatively, after step (e), at least one twisted wire 12 filled with the electron emission particles 14 and at least one conductive wire can be twisted together. Thus, the thermal electron emitter 20 has a high mechanical durability and flexility. The conductive wire can be made of metal or graphite.

Furthermore, the twisted wire 12 is attached to first and second electrodes 16, 18 by a conductive paste/adhesive to form a thermal electron emission device 10. The conductive paste/adhesive can be conductive silver paste. One end of the carbon nanotube twisted wire 12 will be attached to the first electrode 16, and the opposite end of the carbon nanotube twisted wire 12 will be attached to the second electrode 18.

It is to be understood that the above-described embodiments are intended to illustrate, rather than limit, the invention. Variations may be made to the embodiments without departing from the spirit of the invention as claimed. The above-described embodiments illustrate the scope of the invention but do not restrict the scope of the invention.

It is also to be understood that the above description and the claims drawn to a method may include some indication in reference to certain steps. However, the indication used is only to be viewed for identification purposes and not as a suggestion as to an order for the steps.

What is claimed is:

1. A method for making a thermal electron emitter, the method comprising:

(a) providing a carbon nanotube film;

(b) treating the carbon nanotube film with a solution comprising a first solvent and a compound or a precursor of the compound to form a treated carbon nanotube film, wherein the compound has a work function that is lower than a work function of the carbon nanotube film;

(c) twisting the treated carbon nanotube film to form a carbon nanotube twisted wire;

(d) drying the carbon nanotube twisted wire; and (e) activating the carbon nanotube twisted wire.

2. The method as claimed in claim 1, wherein in step (a) the carbon nanotube film is formed by pressing a carbon nanotube array with a pressing device.

3. The method as claimed in claim 1, wherein step (a) comprises steps of:

(a1') putting a plurality of carbon nanotubes into a second solvent;

(a2') causing the plurality of carbon nanotubes to be clumped together into a floc structure;

(a3') separating the floc structure from the second solvent; and (a4') shaping the floc structure to obtain the carbon nanotube film.

4. The method as claimed in claim 1, wherein the solution is applied to the carbon nanotube film.

5. The method as claimed in claim 1, wherein the carbon nanotube film is immersed into the solution.

6. The method as claimed in claim 5, wherein the carbon nanotube film is immersed for a period of time ranging from about 1 second to about 30 seconds.

7. The method as claimed in claim 1, wherein the compound comprises a material selected from the group consisting of alkaline earth metal oxide, alkaline earth metal boride, and a mixture thereof

8. The method as claimed in claim 1, wherein the precursor of the compound is an alkaline earth metal salt.

9. The method as claimed in claim 8, wherein the alkaline earth metal salt is selected from the group consisting of barium nitrate, strontium nitrate, calcium nitrate, and any combinations thereof.

10. The method as claimed in claim 1, wherein the solvent comprises a material selected from the group consisting of water, ethanol, methanol, acetone, dichloroethane, chloroform, and any combinations thereof.

11. The method as claimed in claim 1, wherein the treated carbon nanotube film is twisted with a mechanical force.

12. The method as claimed in claim 11, wherein step (c) comprises steps of:

(c1) adhering a tool to at least one portion of the treated carbon nanotube film; and (c2) turning the tool to twist the treated carbon nanotube film.

13. The method as claimed in claim 1, wherein the carbon nanotube twisted wire is dried in air with a temperature of about 100° C. to about 400° C.

14. The method as claimed in claim 1, wherein the carbon nanotube twisted wire is activated in a vacuum.

15. The method as claimed in claim 14, wherein step (e) comprises steps of:

(e1) placing the carbon nanotube twisted wire in the vacuum; and (e2) applying a voltage to the carbon nanotube twisted wire, causing the carbon nanotube twisted wire to reach a temperature ranging from about 800° C. to about 1400° C. for about 1 minute to about 60 minutes.

16. The method as claimed in claim 15, wherein a gas pressure of the vacuum ranges from about $10^{-2}$ Pascals to about $10^{-6}$ Pascals.

17. The method as claimed in claim 1, further comprising a step of twisting at least two carbon nanotube twisted wires with each other after step (e).

18. The method as claimed in claim 1, further comprising a step of twisting at least one carbon nanotube twisted wire and at least one conductive wire with each other after step (e).

19. A method for making a thermal electron emitter, the method comprising:

providing a carbon nanotube film;

treating the carbon nanotube film with a solution comprising a solvent and a compound or a precursor of the compound to form a treated carbon nanotube film, wherein the compound has a work function that is lower than a work function of the carbon nanotube film;

twisting the treated carbon nanotube film to form a carbon nanotube twisted wire;

drying the carbon nanotube twisted wire;

placing the carbon nanotube twisted wire in a vacuum or an inert gas atmosphere; and applying a voltage to the carbon nanotube twisted wire to heat the compound or the precursor in the carbon nanotube twisted wire so that the carbon nanotube twisted wire is activated.

20. A method for making a thermal electron emitter, the method comprising:

providing a carbon nanotube film;

treating the carbon nanotube film with a solution comprising a solvent and a precursor of a compound to form a treated carbon nanotube film;

twisting the treated carbon nanotube film to form a carbon nanotube twisted wire;

drying the carbon nanotube twisted wire;

placing the carbon nanotube twisted wire in a vacuum or an inert gas atmosphere; and heating the precursor in the carbon nanotube twisted wire in manner such that the precursor is decomposed into the compound having a work function that is lower than a work function of the carbon nanotube film.

* * * * *